US005287094A

United States Patent [19]

Yi

[11] Patent Number: 5,287,094

[45] Date of Patent: Feb. 15, 1994

[54] METHOD AND APPARATUS FOR PROCESSING A LINE-GRAPHIC IN A 2 BYTES CHARACTER MODE OF A DISPLAY ADAPTER UNIT

[75] Inventor: Kyoung K. Yi, Seoul, Rep. of Korea

[73] Assignee: Goldstar Co., Ltd., Rep. of Korea

[21] Appl. No.: 921,295

[22] Filed: Jul. 28, 1992

[30] Foreign Application Priority Data

Jul. 29, 1991 [KR] Rep. of Korea ..... 13018/1991

[51] Int. Cl.[5] ..... G09G 1/14; G09G 1/06

[52] U.S. Cl. ..... 345/143; 345/141; 340/750; 340/751

[58] Field of Search ..... 340/735, 748, 749, 750, 340/751; 395/150, 151; 307/518; 328/108; 400/110

[56] References Cited

U.S. PATENT DOCUMENTS

| | | | |
|---|---|---|---|
| 4,723,217 | 2/1988 | Nakano et al. | 395/150 |
| 4,954,979 | 9/1990 | Eibner et al. | 395/150 |
| 5,124,694 | 6/1992 | Dien | 340/735 |

*Primary Examiner*—Ulysses Weldon
*Assistant Examiner*—Matthew Luu
*Attorney, Agent, or Firm*—Ostrolenk, Faber, Gerb & Soffen

[57] ABSTRACT

A method and apparatus for processing a line-graphic in a 2 bytes character mode of a display adapter unit, whereby a line-graphic code can be prevented from being misdiscriminated as a 2 bytes character code in the 2 bytes character mode and be thus processed as a line on a screen. The apparatus comprises a code discriminator for retrieving the most significant bit of each of character codes inputted therein to discriminate whether each of the character codes is a 1 byte character code or a 2 bytes character code and generating a 1 byte/2 bytes character code discriminate signal depending on each of the retrieved most significant bit values, a line-graphic discriminator for decoding each of the character codes inputted therein and generating a line-graphic code discriminate signal if line-graphic codes are inputted successively above a predetermined number of times in accordance with the decoded result, such that the line-graphic codes are processed as 1 byte character codes, and an AND gate for ANDing output signals from the code discriminator and the line-graphic discriminator and outputting the ANDed signal as the final 1 byte/2 bytes character code discriminate signal.

5 Claims, 7 Drawing Sheets

METHOD AND APPARATUS FOR PROCESSING A LINE-GRAPHIC IN A 2 BYTES CHARACTER MODE OF A DISPLAY ADAPTER UNIT

BACKGROUND OF THE INVENTION

1. Field of the Invention

The present invention relates in general to a display adapter unit for a computer, and more particularly to a method and apparatus for processing a line-graphic in a 2 bytes character mode of a display adapter unit, whereby a line-graphic code can be prevented from being mis-discriminated as a 2 bytes character code in the 2 bytes character mode and thus processed as a line on a screen.

2. Description of the Prior Art

In a computer, generally, binary values of 0 to 255 may be used to represent all characters, numbers and symbols designated by a disk operating system (DOS). The former or first 128 values (0–127) may be used to represent general numbers, characters and punctuations and are known as a set of ASCII characters. The latter or last 128 values (128–255) may be used as extended ASCII characters.

On the other hand, in a case (for example, Hangul or Chinese character) where each characters cannot be represented by only 1 byte , 2 bytes data may be used to represent one character. 128–255 values are applied to 2 bytes character codes and the most significant bit (the eighth bit:MSB) of each of the codes is "1". In this case, the most significant bit MSB is used for identification and the remaining 7 bits are data bits.

For this reason, in a case where a computer is operated in a 2 bytes character mode such as, for example, Hangul or Chinese character, in order to use 1 byte character codes capable of representing alphabetical characters or extended ASCII characters in an application program of the 2 bytes character mode, there is a necessity for discriminating between the 2 bytes and 1 byte character codes.

A conventional method of discriminating the 1 byte character code from the 2 bytes character code is performed by utilizing a 1 byte/2 bytes character code discriminator 1 as shown in FIG. 1, which is a block diagram of the code discriminator 1. The 1 byte/2 bytes character code discriminator 1 retrieves the most significant bit MSB of each of character codes CR inputted therein to discriminate whether the most significant bit MSB value is "1" or "0 ". If the most significant bit MSB value is "1", the character code CR is the 2 bytes character code. On the contrary, if the most significant bit MSB value is "0", the character code CR is the 1 byte character code.

The operation of the 1 byte/2 bytes character code discriminator 1 is performed as shown in FIG. 2.

Referring to FIG. 2, there is shown a flowchart illustrating the operation of the 1 byte/2 bytes character code discriminator 1. In operation, the 1 byte/2 bytes character code discriminator 1, upon inputting the character codes CR at its input terminal IN, decodes the character codes CR to discriminate whether the most significant bit MSB value of each of the codes is "1" or "0". If the most significant bit MSB value of the current inputted character code is "0" as a result of decoding 1 byte of the code, the 1 byte/2 bytes character code discriminator 1 discriminates the current inputted character code as the 1 byte character code and thus outputs a 1 byte character code discriminate signal (H/E="0") at its output terminal OUT. As a result, the current inputted character code is processed as the 1 byte character code.

On the other hand, if the most significant bit MSB value of the current inputted character code is "1" as a result of decoding the 1 byte of the code, the 1 byte/2 bytes character code discriminator 1 decodes 1 byte of the next inputted character code. If the most significant bit MSB value of the next inputted character code is "0" in accordance with the decoded result, the 1 byte/2 bytes character code discriminator 1 discriminates the current and next inputted character codes respectively as the 1 byte character codes and thus outputs the 1 byte character code discriminate signals (H/E="0") at its output terminal OUT. As a result, the current and next inputted character codes are processed as the 1 byte character code, respectively.

On the contrary, if the most significant bit MSB value of the current inputted character code is "1" and the most significant bit MSB value of the next inputted character code is "1", the 1 byte/2 bytes character code discriminator 1 discriminates a combination of the current and next inputted character codes as the 2 bytes character code and thus outputs a 2 bytes character code discriminate signal (H/E="1") at its output terminal OUT. As a result, the combination of the current and next inputted character codes is processed as the 2 bytes character code, since the most significant bit MSB values of the inputted two successive character codes are "1" all.

On the other hand, in a case where 1 byte characters are used to execute an application program in the 2 bytes character mode, ASCII application codes in which the most significant bit MSB values all are "1" may be used as line-graphic codes for depicting lines, perhaps horizontal lines. As a result, in this case, the character codes in which the most significant bit MSB values all are "1" are inputted successively. Namely, the most significant bit MSB values of the two successive character codes are "1" all. This causes the above-mentioned conventional 1 byte/2 bytes character code discriminator 1 to mis-discriminate the line-graphic codes to be processed as the 1 byte character codes, as the 2 bytes character codes. For this reason, when the application program is executed to depict graphics such as, for example, tables in the 2 bytes character mode using the 1 byte character codes, graphic lines of the tables to be depicted may be represented as 2 bytes characters in the application program.

For instance, as shown in FIG. 3A, in the 1 byte character mode, row lines P1 and row-coloum cross points P2 of a table are displayed normally on the screen, while, in the 2 bytes character mode, codes C4 for depicting the row lines P1 may be displayed as specified 2 bytes characters (for example, " . . . " in Hangul mode) on the screen as shown in FIG. 3B. As a result, it is difficult for the user to grasp the table on the screen.

SUMMARY OF THE INVENTION

Therefore, it is an object of the present invention to provide a method and apparatus for processing a line-graphic in a 2 bytes character mode of a display adapter unit, whereby a line-graphic code can be processed as a 1 byte character code when a computer is operated in the 2 bytes character mode using the display adapter unit, thereby resulting in a provision of line-drawing with no error.

In accordance with one aspect of the present invention, there is provided a method of processing a line-graphic in a 2 bytes character mode of display adapter unit, comprising: a 1 byte/2 bytes character code discriminating step of generating a 1 byte/2 bytes character code discriminate signal depending on the most significant bit value of each of inputted character codes; an up-counting step of decoding each of the inputted character codes and generating a line-graphic code discriminate signal if character codes of specified code values are inputted successively above a predetermined number of times in accordance with the decoded result, such that the character codes of the specified code values are processed as 1 byte character codes; a down-counting step of checking said up-counting step, down-counting the predetermined number of times if it is checked that the character codes of the specified code value are not inputted successively further after being inputted successively above the predetermined number of times and maintaining the line-graphic code discriminate signal naturally during the down-counting operation; and a discriminate signal output step of combining the 1 byte/2 bytes character code discriminate signal from said 1 byte/2 bytes character code discriminating step with the line-graphic code discriminate signals from said up-counting step and down-counting step and outputting the combined signal as the final 1 byte/2 bytes character code discriminate signal such that the character codes of the specified code values can be processed as the 1 byte character codes.

In accordance with another aspect of the present invention, there is provided an apparatus for processing a line-graphic in a 2 bytes character mode of a display adapter unit, comprising: a code discriminator for retrieving the most significant bit of each of character codes inputted therein to discriminate whether each of the character codes is a 1 byte character code or a 2 bytes character code and generating a 1 byte/2 bytes character code discriminate signal depending on each of the retrieved most significant bit values; a line-graphic discriminator for decoding each of the character codes inputted therein and generating a line-graphic code discriminate signal if line-graphic codes are inputted successively above a predetermined number of times in accordance with the decoded result, such that the line-graphic codes are processed as 1 byte character codes; and a gate section for ANDing output signals from the code discriminator and the line-graphic discriminator and outputting the ANDed signal as the final 1 byte/2 bytes character code discriminate signal.

BRIEF DESCRIPTION OF THE DRAWINGS

The above and other objects, features and advantages of the present invention will be more clearly understood from the following detailed description taken in conjunction with the accompanying drawings, in which:

FIGS. 3A and 3B are views illustrating a problem encountered in the prior art, wherein:

FIG. 3A is a table which is displayed on a screen in a 1 byte character mode; and FIG. 3B is a table which is displayed on the screen in a 2 bytes character mode;

FIGS. 7A and 7B are views illustrating a line-graphic process in accordance with the present invention, wherein:

FIG. 7A is a table which is displayed on the screen in the 1 byte character mode; and FIG. 7B is a table which is displayed on the screen in the 2 bytes character mode.

DETAILED DESCRIPTION OF THE INVENTION

Figure 1:
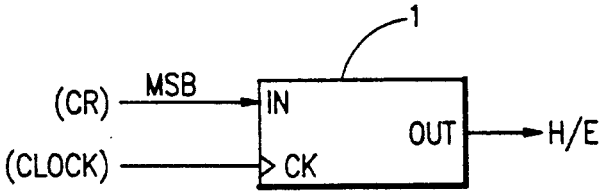
FIG. 1 PRIOR ART
FIG. 1 is a block diagram of a conventional 1 byte/2 bytes character code discriminator.
Figure 2:
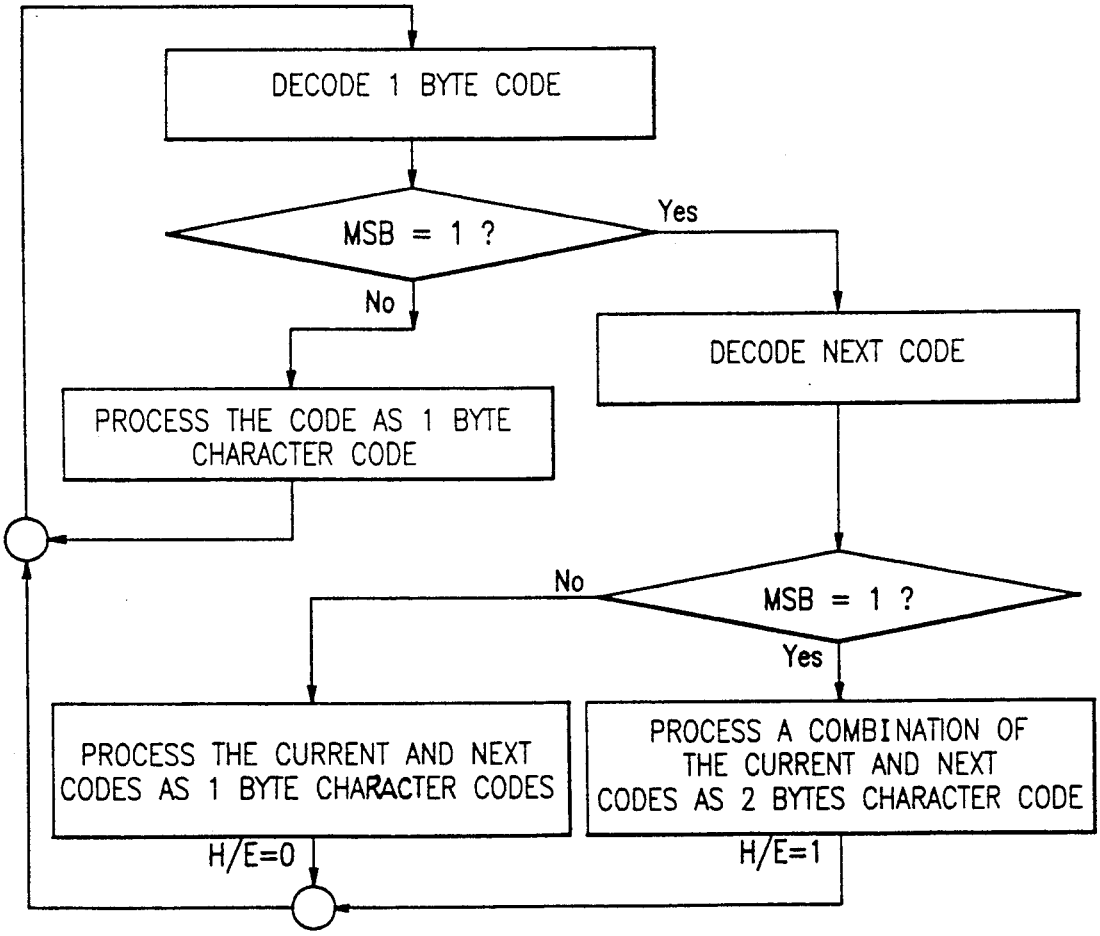
FIG. 2 PRIOR ART
FIG. 2 is a flowchart illustrating the operation of the conventional 1 byte/2 bytes character code discriminator in FIG. 1.
Figure 3A:
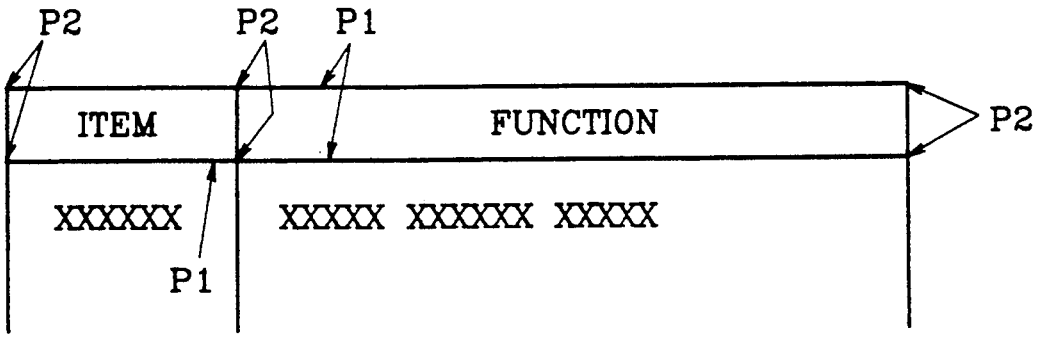
FIG. 3A PRIOR ART
Figure 3B:
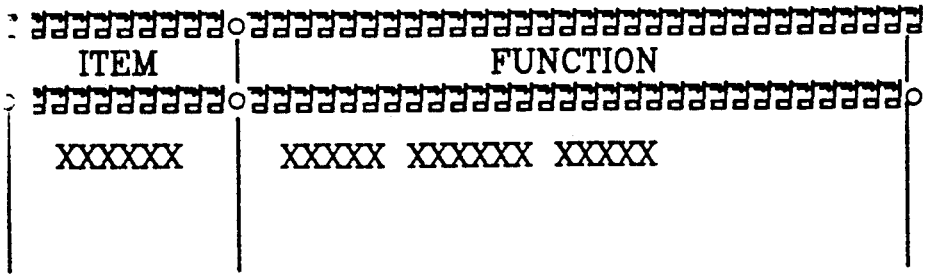
FIG. 3B PRIOR ART
Figure 4:
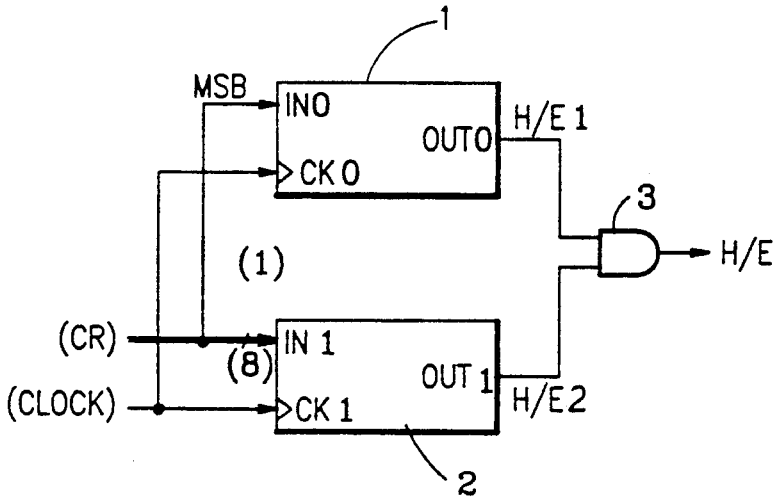
FIG. 4 is a block diagram of an apparatus for processing a line-graphic in a 2 bytes character mode of a display adapter unit in accordance with an embodiment of the present invention.

Referring to FIG. 4, there is shown a block diagram of an apparatus for processing a line-graphic in a 2 bytes character mode of a display adapter unit in accordance with an embodiment of the present invention. As shown in this figure, the apparatus of the present invention comprises a code discriminator 1 for retrieving the most significant bit MSB of each of character codes CR inputted therein to discriminate whether each of the character codes CR is a 1 byte character code or a 2 bytes character code and generating a 1 byte/2 bytes character code discriminate signal H/E1 depending on each of the retrieved most significant bit MSB values, a line-graphic discriminator 2 for decoding each of the character codes CR inputted therein and generating a line-graphic code discriminate signal H/E2 if line-graphic codes are inputted successively above a predetermined number of times in accordance with the decoded result, such that the line-graphic codes are processed as 1 byte character codes, and an AND gate 3 for ANDing output signals from the code discriminator 1 and the line-graphic discriminator 2 and outputting the ANDed signal as the final 1 byte/2 bytes character code discriminate signal H/E.

A method of processing the line-graphic in the 2 bytes character mode of the display adapter unit in accordance with the embodiment of the present invention will now be described.

The method of the invention comprises a 1 byte/2 bytes character code discriminating step of generating the 1 byte/2 bytes character code discriminate signal H/E1 depending on the most significant bit MSB value of each of the inputted character codes CR, an up-counting step of decoding each of the inputted character codes CR and generating the line-graphic code discriminate signal H/E2 if character codes of specified code values, or the line-graphic codes are inputted successively above the predetermined number of times in accordance with the decoded result, such that the character codes of the specified code values are processed as the 1 byte character codes, a down-counting step of checking the up-counting step, down-counting the predetermined number of times if it is checked that the character codes of the specified code values are not inputted successively further after being inputted successively above the predetermined number of times and maintaining the line-graphic code discriminate signal H/E2 naturally during the down-counting operation, and a discriminate signal output step of combining the 1 byte/2 bytes character code discriminate signal H/E1 from the 1 byte/2 bytes character code discriminating step with the line-graphic code discriminate signals H/E2 from the up-counting step and the down-counting step and outputting the combined signal as the final 1 byte/2 bytes character code discriminate signal H/E such that the line-graphic codes can be processed as the 1 byte character codes.

Figure 5:
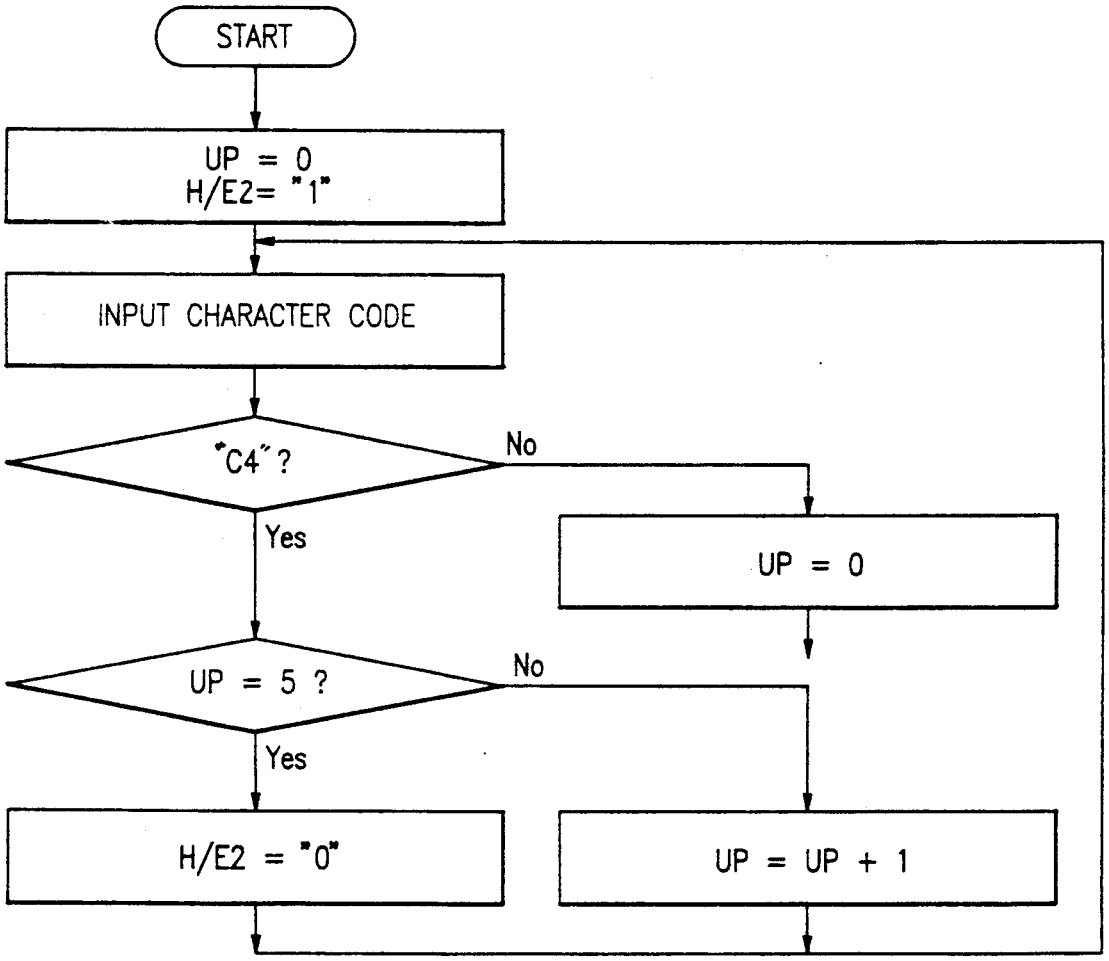
FIG. 5 is a flowchart illustrating an up-counting operation of a line-graphic discriminator in the apparatus in FIG. 4.

Referring to FIG. 5, there is shown a flowchart illustrating the up-counting operation of the line-graphic discriminator 2 in the apparatus in FIG. 4. As shown in this figure, the up-counting step of the present method includes a step of initializing an up-count value (UP=0), outputting the line-graphic code discriminate signal H/E2 as a 2 bytes character code discriminate signal (H/E2="1") and then inputting a character code, a step of discriminating whether the inputted character code is the specified value code (for example, "C4") and, if the inputted character code is not the specified value code, initializing the up-count value (UP=0) and then returning to the character code input step to input the next character code, a step of discriminating whether the up-count value is a predetermined value (UP=5) if the inputted character code is the specified value code and, if the up-count value is not the predetermined value, incrementing the up-count value (UP=UP+1) and then returning to the character code input step to input the next character code, and a step of outputting the line-graphic code discriminate signal H/E2 as a 1 bytes character code discriminate signal (H/E2="0") if the up-count value is the predetermined value or if the specified value codes are inputted successively by the predetermined number of times (UP=5) and then returning to the character code input step to input the next character code.

Figure 6:
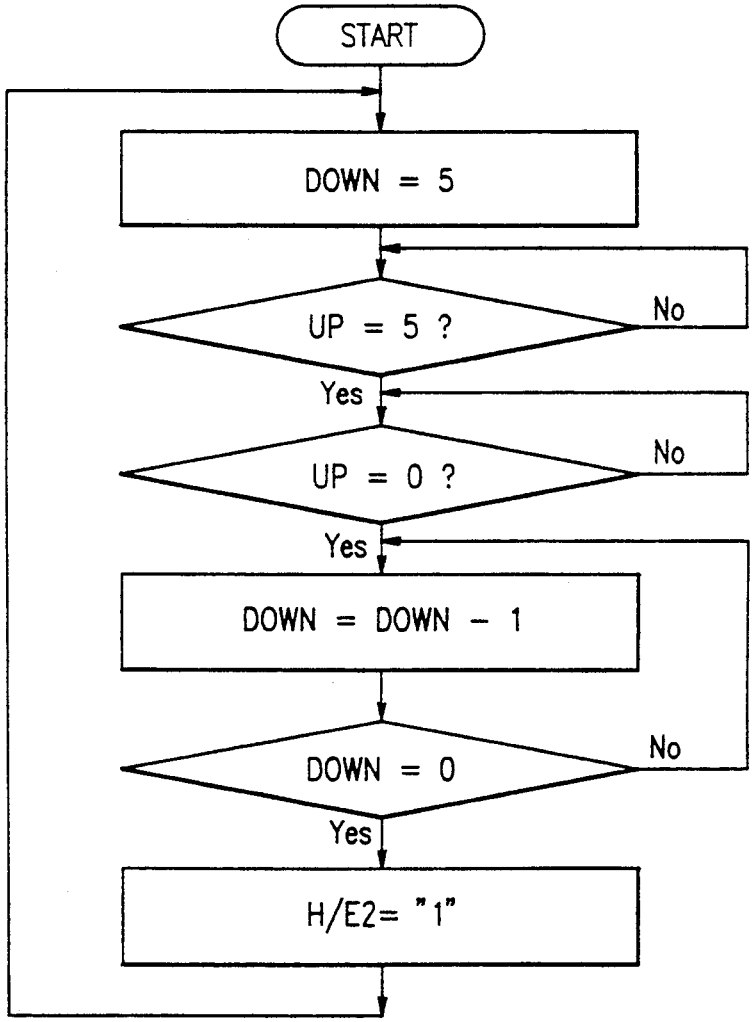
FIG. 6 is a flowchart illustrating a down-counting operation of the line-graphic discriminator in the apparatus in FIG. 4.
Figure 7A:
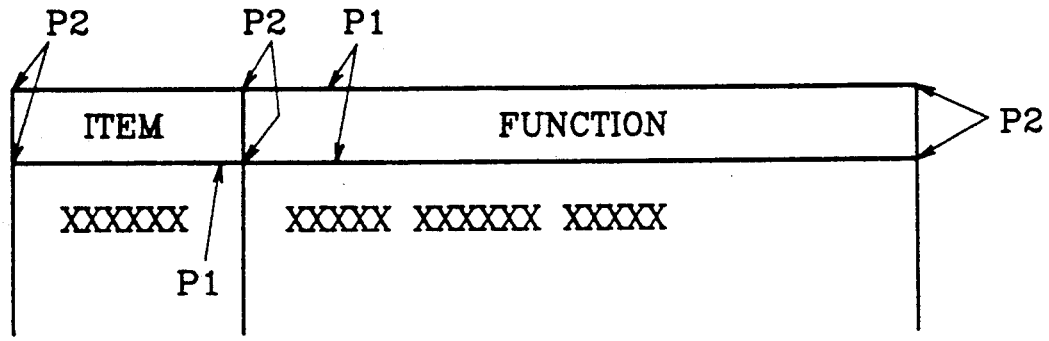
Figure 7B:
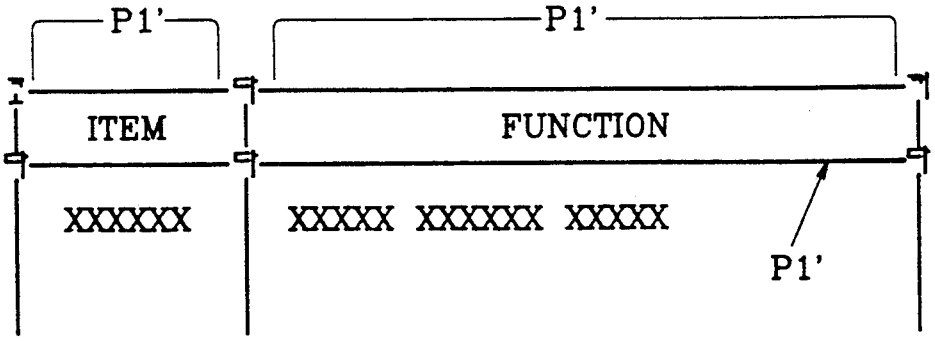

Referring to FIG. 6, there is shown a flowchart illustrating the down-counting operation of the line-graphic discriminator 2 in the apparatus in FIG. 4. As shown in this figure, the down-counting step of the present method includes a step of setting a down-count value to the predetermined value (DOWN=5) and then waiting until the up-count value is in accord with the predetermined value (UP=5), a step of waiting until the up-count value is reset (UP=0) if the up-count value is in accord with the predetermined value (UP=5), a step of decrementing the down-count value (DOWN−1) if the up-count value is reset (UP=0) and performing the down-counting operation synchronously with the input timing of the character codes CR until the down-count value is in accord with zero (0), and a step of outputting the line-graphic code discriminate signal H/E2 as the 2 bytes character code discriminate signal (H/E2="1") if the down-counting operation is completed and then returning to the step of setting the down-count value to the predetermined value (DOWN=5) and then waiting until the up-count value is in accord with the predetermined value (UP=5).

Upon inputting the character codes CR when a computer is being operated in the 2 bytes character mode, the 1 byte/2 bytes character code discriminator 1 retrieves the most significant bit MSB value of each of the inputted character codes CR. If the most significant bit MSB value of the current inputted character code is "0" as a result of retrieving 1 byte of the code, the 1 byte/2 bytes character code discriminator 1 discriminates the current inputted character code as the 1 byte character code and thus outputs the 1 byte character code discriminate signal (H/E1="0"). On the other hand, if the most significant bit MSB value of the current inputted character code is "1" as a result of retrieving the 1 byte of the code, the 1 byte/2 bytes character code discriminator 1 discriminates the 1 byte/2 bytes character codes on the basis of the most significant bit MSB value of the next inputted character code and outputs the 1 byte/2 bytes character code discriminate signals H/E1 in accordance with the discriminated results.

If the most significant bit MSB value of the current inputted character code is "1" and the most significant bit MSB value of the next inputted character code is "0", the 1 byte/2 bytes character code discriminator 1 discriminates the current and next inputted character codes respectively as the 1 byte character codes and thus outputs the 1 byte character code discriminate signals (H/E1="0"). On the contrary, if the most significant bit MSB value of the current inputted character code is "1" and the most significant bit MSB value of the next inputted character code is "1", the 1 byte/2 bytes character code discriminator 1 discriminates a combination of the current and next inputted character codes as the 2 bytes character code and thus outputs the 2 bytes character code discriminate signal (H/E1="1").

In result, the code discriminator 1 outputs "0" upon inputting the 1 byte character code, while "1" upon inputting the 2 bytes character code.

On the other hand, the line-graphic discriminator 2 first discriminates whether the inputted character code CR is the specified value code (for example, "C4"). If the inputted character code CR is the specified value code, the line-graphic discriminator 2 counts the number of times that the specified value codes are inputted successively. In a case where the specified value codes are inputted successively above the predetermined number of times, the line-graphic discriminator 2 outputs the line-graphic code discriminate signal H/E2 as the 1 byte character code discriminate signal (H/E2="0") such that the specified value codes or the line-graphic codes are processed as the 1 byte character codes.

The line-graphic discriminator 2 also down-counts the predetermined number of times if the specified value codes are not inputted successively further after being inputted successively above the predetermined number of times, and continuously outputs the line-graphic code discriminate signal H/E2 as the 1 byte character code discriminate signal (H/E2="0") until the down-counting operation is completed. Upon completion of the down-counting operation, the line-graphic discriminator 2 outputs the line-graphic code discriminate signal H/E2 as the 2 bytes character code discriminate signal (H/E2="1").

In other words, the specified value code (C4) is displayed as a line ("_") in the 1 byte character mode, while as a specified character (for example, " " in Hangul mode) in the 2 bytes character mode.

It should be noted that, in the 2 bytes character mode, there is no word in which a character resulting from the specified value code is repeated above 5 times. For this reason, in the case where the line-graphic code is repeated above 5 times, the line-graphic code is processed as the 1 byte character code, thereby enabling a process of line-drawing with no error. Herein, an example of the specified value code is a code for depicting a line-graphic among the 1 byte character codes ("_"="C4" or "CD").

The line-graphic discriminator 2 may also have a pipelined parallel configuration. This parallel configuration of the line-graphic discriminator 2 enables the parallel processing of up-counting the number of times that the specified value codes are inputted successively and down-counting the predetermined number of times such that the specified value codes inputted successively above the predetermined number of times all are processed as the 1 byte character codes.

Therefore, the line-graphic discriminator 2 outputs "0" upon inputting the specified value codes successively above the predetermined number of times. Also, although the successive inputs of the specified value codes have been ended, the line-graphic discriminator 2 maintains its output signal "0" by the predetermined number of times and thereafter outputs "1" such that the specified value codes inputted successively above the predetermined number of times all are processed as the 1 byte character codes.

Then, the AND gate 3 ANDs the 1 byte/2 bytes character code discriminate signal H/E1 from the code discriminator 1 and the line-graphic code discriminate signal H/E2 from the line-graphic discriminator 2. Thus outputted from the AND gate 3 are the ANDed signal as the final 1 byte/2 bytes character code discriminate signal H/E.

As mentioned above, therefore, if the inputted character code is the 2 bytes character code when the computer is being operated in the 2 bytes character mode, the AND gate 3 outputs "1" enabling the inputted character code to be processed as the 2 bytes character code. Also, if the inputted character code is the 1 byte character code in which the most significant bit MSB value is "0", the AND gate 3 outputs "0"enabling the inputted character code to be processed as the 1 byte character code. Also, if the successively inputted two character codes are the 1 byte character codes which the most significant bit MSB values are "1" and "0" respectively, the AND gate 3 outputs "0" enabling the successively inputted two character codes to be processed respectively as the 1 byte character codes. Also upon input of the 1 byte character codes having the most significant bit MSB values of "1" respectively and being the specified value codes succeeded above the predetermined number of times such as the line-graphic codes, the line-graphic discriminator 2 outputs "0" and the AND gate 3 thus outputs "0" enabling the line-graphic codes to be processed as the 1 byte character codes.

Noticeably, the code discriminator 1 may provide the 1 byte/2 bytes character code discrimination signal H/E1 outputs which are delayed by the number of clocks defining the predetermined number of times to be synchronized with an output timing of the line-graphic code discriminate signal H/E2 from the line-graphic discriminator 2. Also, a process of displaying the character codes may have such a timing that it is performed in response to the 1 bytes/2 bytes character code discriminate signals H/E from the AND gate 3.

Figure 8:
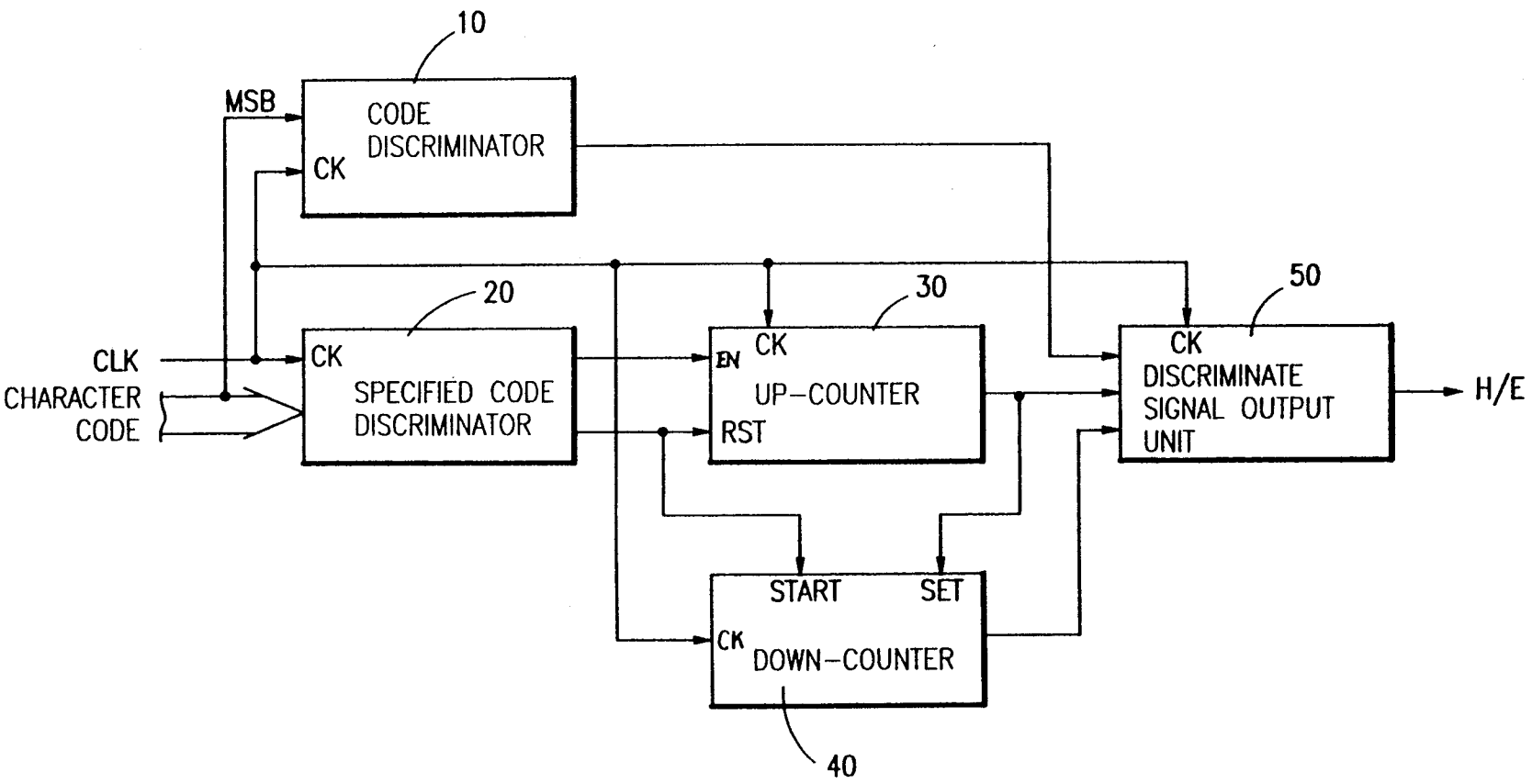
FIG. 8 is a block diagram of an apparatus for processing a line-graphic in a 2 bytes character mode of a display adapter unit in accordance with an alternative embodiment of the present invention.

Referring to FIG. 8, there is shown a block diagram of an apparatus for processing a line-graphic in a 2 bytes character mode of a display adapter unit in accordance with an alternative embodiment of the present invention. As shown in this figure, the apparatus of the present invention comprises a code discriminator 10 for retrieving the most significant bit MSB of each of character codes inputted therein to discriminate whether each of the character codes is a 1 byte character code or a 2 bytes character code, a specified code discriminator 20 for decoding each of the character codes inputted therein to discriminate whether the inputted character codes are specified value codes for depicting line-graphics in a 1 byte character mode, an up-counter 30 for up-counting the number of times that the specified value codes are inputted successively if it is discriminated in the specified code discriminator 20 that the inputted character codes are the specified value codes and being reset if it is discriminated in the specified code discriminator 20 that the inputted character codes are not the specified value codes, a down-counter 40 for setting a down-count value to a predetermined value if an up-count value of the up-counter 30 is in accord with the predetermined value and then performing a down-counting operation if the up-counter 20 is reset, and a discriminate signal output unit 50 for ANDing output signals from the code discriminator 10, the up-counter 30 and the down-counter 40 and outputting the ANDed signal as a 1 byte/2 bytes character code discriminate signal H/E such that line-graphic codes discriminated as the 2 bytes character codes are processed as the 1 byte character codes.

Now, the operation of the above-mentioned construction in accordance with the alternative embodiment of the present invention will be described.

In operation, upon inputting the character codes, the code discriminator 10 retrieves the most significant bit MSB of each of the inputted character codes to discriminate whether each of the character codes is the 1 byte character code or the 2 bytes character code. In accordance with the discriminated results, the code discriminator 10 outputs "0" if the inputted character code is the 1 byte character code, while "1" if the inputted character code is the 2 bytes character code.

At this time, the specified code discriminator 20 decodes each of the character codes inputted therein to discriminate whether the inputted character codes are the specified value codes. In accordance with the discriminated results, the specified code discriminator 20 outputs a count signal to the up-counter 30 if the inputted character code is the specified value code, while a reset signal to the up-counter 30 if the inputted character code is not the specified value code.

Upon application of the count signal from the specified code discriminator 20, the up-counter 30 up-counts the number of times that the specified value codes are inputted successively. Then, the up-counter 30 outputs a low signal ("0") when the up-count value thereof becomes the predetermined value (for example, 5).

With the low signal being outputted from the up-counter 30, the down-counter 40 sets the down-count value to the predetermined value (DOWN=5). At this time, since the up-counter 30 outputs "0" although the code discriminator 10 outputs "1", the discriminate signal output unit 50 outputs the 1 byte character code discriminate signal (H/E="0"). Thus, the character codes of the specified code values can be processed as the 1 byte character codes.

Thereafter upon inputting no character codes of the specified code values, the specified code discriminator 20 outputs the reset signal. The reset signal from the specified code discriminator 20 is applied as a start signal to the down-counter 40, while as the reset signal to the up-counter 30. The down-counter 40 thus starts the down-counting operation in response to the applied start signal.

At this time, the discriminate signal output unit 50 outputs the 1 byte character code discriminate signal (H/E="0") until the down-counting operation of the down-counter 40 is completed, since the down-counter 40 outputs "0 " until the down-counting operation is completed although the code discriminator 10 outputs "1" and the up-counter 30 outputs "1".

As a result, the successively inputted specified value codes or the successively inputted line-graphic codes all can be processed as the 1 byte character codes.

As hereinbefore described, according to the present invention, the line-graphic code can be processed as the 1 byte character code when the computer is operated in the 2 bytes character mode using the display adapter unit, thereby resulting in a provision of accurate line-drawing with no error. Therefore, even in the 2 bytes character mode, there can be provided a line-drawn picture on the screen which the user can readily grasp.

Although the preferred embodiment of the present invention have been disclosed for illustrative purpose, those skilled in the art will appreciate that various modifications, additions and substitutions are possible; without departing from the scope and spirit of the invention as disclosed in the accompanying claims.

What is claimed is:

1. A method of processing a line-graphic in a 2 bytes character mode of a display adapter unit, comprising:

a 1 byte or 2 bytes character code discriminating step including generating a 1 byte or 2 bytes character code discriminate signal depending on the most significant bit value of each of inputted character codes;

an up-counting step including decoding each of the inputted character codes and generating a line-graphic code discriminate signal if character codes of specified code values are inputted successively above a predetermined number of times in accordance with a decoded result, such that the character codes of the specified code values are processed as 1 byte character codes;

a down-counting step including checking said up-counting step, down-counting the predetermined number of times if it is found that the character codes of the specified code value are not inputted successively further after being inputted successively above the predetermined number of times and maintaining the line-graphic code discriminate signal naturally during the down-counting operation; and a discriminate signal output step including combining the 1 byte or 2 bytes character code discriminate signal with the line-graphic code discriminate signals and for outputting the combined signal as a final 1 or 2 bytes character code discriminate signal such that the character codes of the specified code values can be processed as the 1 byte character code.

2. A method of processing a line-graphic in a 2 bytes character mode of a display adapter unit, as set forth in claim 1, wherein said up-counting step includes the steps of:

initializing an up-count value, outputting the line-graphic code discriminate signal as a 2 bytes character code discriminate signal and then inputting a character code;

discriminating whether the inputted character code is the specified value code and, if the inputted character code is not the specified value code, initializing the up-count value and then returning to the character code input step to input the next character code;

discriminating whether the up-count value is a predetermined value if the inputted character code is the specified value code and, if the up-count value is not the predetermined value, incrementing the up-count value and then returning to the character code input step to input the next character code; and outputting the line-graphic code discriminate signal as a 1 bytes character code discriminate signal if the up-count value is the predetermined value and then returning to the character code input step to input the next character code.

3. A method of processing a line-graphic in a 2 bytes character mode of a display adapter unit, as set forth in claim 1, wherein said down-counting step includes the steps of:

setting a down-count value to the predetermined value and then waiting until the up-count value is in accord with the predetermined value;

waiting until the up-count value is reset if the up-count value is in accord with the predetermined value;

decrementing the down-count value if the up-count value is reset and performing the down-counting operation synchronously with the input timing of the character codes until the down-count value is in accord with zero; and outputting the line-graphic code discriminate signal as the 2 bytes character code discriminate signal if the down-counting operation is completed and then returning to the step of setting the down-count value to the predetermined value and then waiting until the up-count value is in accord with the predetermined value.

4. An apparatus for processing a line-graphic in a 2 bytes character mode of a display adapter unit, comprising:

code discriminating means for retrieving the most significant bit of each of character codes inputted therein to discriminate whether each of the character codes is a 1 byte character code or a 2 bytes character code and generating a 1 byte or 2 bytes character code discriminate signal depending on each of the retrieved most significant bit values;

line-graphic discriminating means for decoding each of the character codes inputted therein and generating a line-graphic code discriminate signal if line-graphic codes are inputted successively above a predetermined number of times in accordance with the decoded result, such that the line-graphic codes are processed as 1 byte character codes; and gate means for ANDing output signals from said code discriminating means and said line-graphic discriminating means and outputting the ANDed signal as a final 1 byte or 2 bytes character code discriminate signal.

5. An apparatus for processing a line-graphic in a 2 bytes character mode of a display adapter unit, comprising:

code discriminating means for retrieving the most significant bit of each of character codes inputted therein to discriminate whether each of the character codes is a 1 byte character code or a 2 bytes character code;

specified code discriminating means for decoding each of the character codes inputted therein to discriminate whether the inputted character codes are specified value codes for depicting line-graphics in a 1 byte character mode;

up-counting means for up-counting the number of times that the specified value codes are inputted successively if it is discriminated in said specified code discriminating means that the inputted character codes are the specified value codes and being reset if it is discriminated in said specified code discriminating means that the inputted character codes are not the specified value codes;

down-counting means for setting a down-count value to a predetermined value if an up-count value of said up-counting means is in accord with the predetermined value and then performing a down-counting operation if said up-counting means is reset; and discriminate signal output means for combining output signals from said code discriminating means, said up-counting means and said down-counting means and outputting a combined signal as a 1 byte or 2 bytes character code discriminate signal such that line-graphic codes discriminated as the 2 bytes character codes are processed as the 1 byte character codes.

* * * * *